United States Patent [19]

Konrad

[11] Patent Number: 5,048,698

[45] Date of Patent: Sep. 17, 1991

[54] OFFICE ACCESSORY MOUNTING RAIL

[75] Inventor: Karl Konrad, Bethlehem, Pa.

[73] Assignee: Westinghouse Electric Corp., Pittsburgh, Pa.

[21] Appl. No.: 536,398

[22] Filed: Jun. 12, 1990

[51] Int. Cl.[5] ..... A47F 7/00

[52] U.S. Cl. ..... 211/45; 211/94; 211/103

[58] Field of Search ..... 211/45, 46, 162, 89, 211/103, 94; 248/224.4, 221.3, 222.1, 225.1

[56] References Cited

U.S. PATENT DOCUMENTS

| | | | |
|---|---|---|---|
| 3,168,954 | 2/1965 | Herrmann . | |
| 3,399,429 | 9/1968 | Goodman . | |
| 3,591,013 | 7/1971 | Herrmann . | |
| 3,675,782 | 7/1972 | Dudley | 211/89 X |
| 3,814,368 | 6/1974 | Freed . | |
| 4,085,848 | 4/1978 | Tsuge . | |
| 4,085,867 | 4/1978 | Heller | 248/224.4 X |
| 4,215,840 | 8/1980 | Babberl . | |
| 4,401,222 | 8/1983 | Kulikowski et al. | 211/103 X |
| 4,467,925 | 8/1984 | Ratzloff et al. . | |
| 4,771,897 | 9/1988 | Ho | 211/94 X |
| 4,773,545 | 9/1988 | Jones | 211/45 X |
| 4,869,378 | 9/1989 | Miller . | |

FOREIGN PATENT DOCUMENTS

| | | | |
|---|---|---|---|
| 399876 | 10/1933 | United Kingdom | 211/46 |

*Primary Examiner*—David L. Talbott

[57] ABSTRACT

An office accessory mounting and display system is disclosed, comprising plural mounting brackets adaptable for securement to various modular office furniture systems, and an elongated, unitarily formed accessory mounting rail for securement to the mounting brackets. Tabs are provided on the mounting brackets to receive complimentary flanges provided on the rear elongated surface of the mounting rail. The rail includes elongated, upward and downward-facing hooks on which plural office accessories or supplies may be attached and displayed or viewed. The rail further includes a downwardly-facing, inverted-"U"-shaped channel which receives plural rod segments for retaining flat sheet material. When the sheet material is pressed into the U-shaped channel, the rod segments are displaced upward; when the sheet material is released, gravitational force pushes the rods down against the interior of the channel, thereby retaining the sheet material in place by frictional force. The sheet material may be removed by pulling downward on the material with force sufficient to overcome the frictional hold between the rod segments, the sheet material, and the interior of the channel.

9 Claims, 3 Drawing Sheets

OFFICE ACCESSORY MOUNTING RAIL

BACKGROUND OF THE INVENTION

1. Field of the Invention

The present invention generally relates to apparatus for suspending and holding office accessories, paper, and other items within reach of an office worker seated at an office furniture system. The present invention specifically relates to accessory mounting rails for connection to office furniture and for display, suspension, and holding of diverse articles adjacent to the work surface for immediate and convenient use by an office worker.

2. Prior Art

Previous office furniture and office systems designers have sought to provide means and apparatus for conveniently locating a variety of papers and other objects in a position conveniently close to an office worker seated near an article of office furniture such as a desk. Such prior art devices include clipboards, which are not self-supporting but rather must be propped against a vertical object to enable the information on the clipboard to be viewed and to prevent the clipboard from collapsing. Another prior art device is the bulletin board, typical examples of which are not only aesthetically unappealing, but generally must be fixed in a single place within the office environment. Bulletin boards are also not suited to holding articles other than paper and cardboard, due to the relatively low holding strength of pushpins and thumbtacks used in conjunction with bulletin boards.

Prior designers have also devised various types of free-standing office supply organizers which combine, in a single housing or unit, means for holding, organizing, and displaying diverse office supply articles such as paper clips, staples, and writing instruments. However, such office supply organizers generally occupy valuable desk space, thereby reducing the amount of desk space available for work operations. Such office supply organizers are also considered unsightly by some furniture designers who desire to provide an office supply display and securement device which is visually and structurally compatible with contemporary modular office furniture systems.

Accordingly, the prior art appears deficient in not including a compact, attractively designed, versatile and space-efficient apparatus for holding, displaying, and securing diverse office supply articles, papers, and related items.

SUMMARY OF THE INVENTION

This need is filled by provision of an elongated office accessory mounting rail for securement between two spaced-apart stanchions or other vertical members having accessory brackets for receiving the ends of the mounting rail. The rail is mounted onto mounting brackets each demountably secured to the shelf accessory bracket preferably provided on the rear vertical wall of the stanchions. Each mounting bracket includes plural teeth for engagement in notches in the vertical brackets of the stanchions, and each bracket further includes plural mounting tabs for engagement with complimentary notches provided on the rear face of the accessory mounting rail. Thus, the rail mounting brackets are each secured using the plural teeth in the stanchion brackets, and the notches provided in each end of the accessory bar are mounted on the rail mounting bracket mounting tabs.

The mounting rail includes front and rear horizontally elongated vertically oriented plates joined approximately at their mid-point by an interior, horizontally oriented elongated web member. The rear surface of the rail is provided with two mounting flanges which cooperate and forcibly fit into the mounting tabs provided on the rail mounting brackets. The rail further includes one forward-facing hook plate on which plural accessories may be hung, and a second, backward-facing hook plate for hangingly securing accessories below and behind the rail.

The rail further includes a downwardly-angled channel defined by the front and rear structural plates and the downward-facing surface of the web plate. Plural steel rod segments are placed in the channel to retain documents. In operation, pushing a piece of sheet material upward into the channel forces the steel rod segment to float upward into the channel. When the sheet of paper is released, gravity forces the steel rod segment downward and thereby presses the sheet material between the steel rod segment exterior and a shoulder rib on the interior surface of the rear rail plate.

One object of the present invention is to provide unitary means for hanging office accessories within easy reach of an office worker seated at modular office furniture and the like, and means for releasibly retaining in place sheet materials such as paper in the same apparatus used to hang such accessories.

A further object of the present invention is to provide means for hanging and releasibly displaying accessories and sheet material which is adaptable to various modular office furniture having opposed, spaced-apart vertical brackets.

A further object of the present invention is to provide means for releasibly retaining sheet material in a position easily accessible by a office worker seated at typical modular office furniture, wherein one sheet or piece of such sheet material may be removed from the retaining device without simultaneously releasing all other sheet material retained in the device.

Still a further object of the present invention is to provide unitary means for hanging plural office accessories and releasibly displaying and holding sheet material which is lightweight, easily manufactured, structurally strong, and visually attractive.

DETAILED DESCRIPTION OF THE PREFERRED EMBODIMENTS

In the present application, specific terminology is used for the sake of clarity. However, the application includes all technical equivalents for such specific terms, and within the scope of the appended description and claims, the invention includes all equivalent means operating in a substantially similar way to accomplish a substantially similar purpose.

Figure 1:
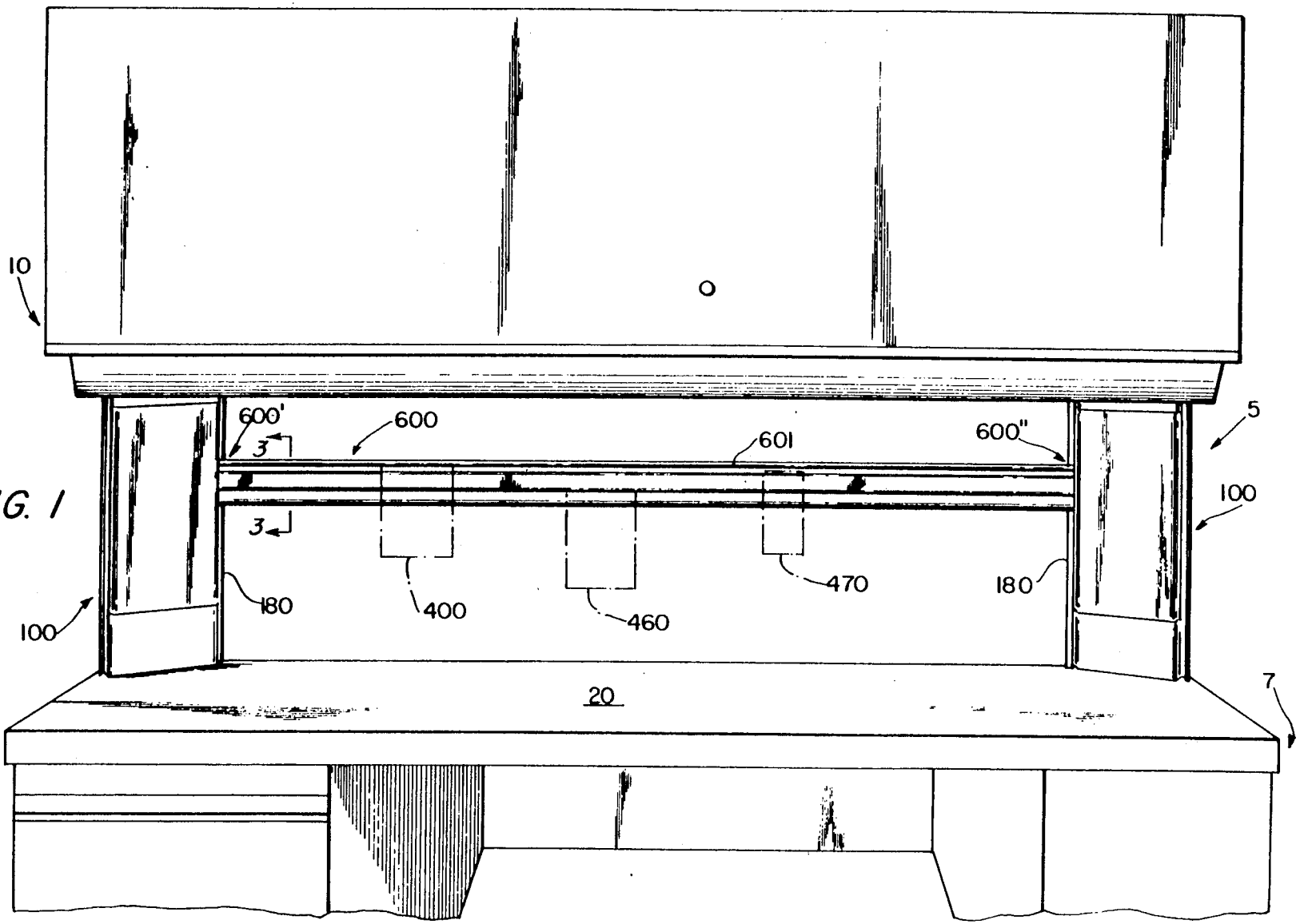
FIG. 1 is a perspective view of an office furniture system showing an accessory mounting rail according to the present invention mounted between two structural stanchions of the system.
Figure 2:
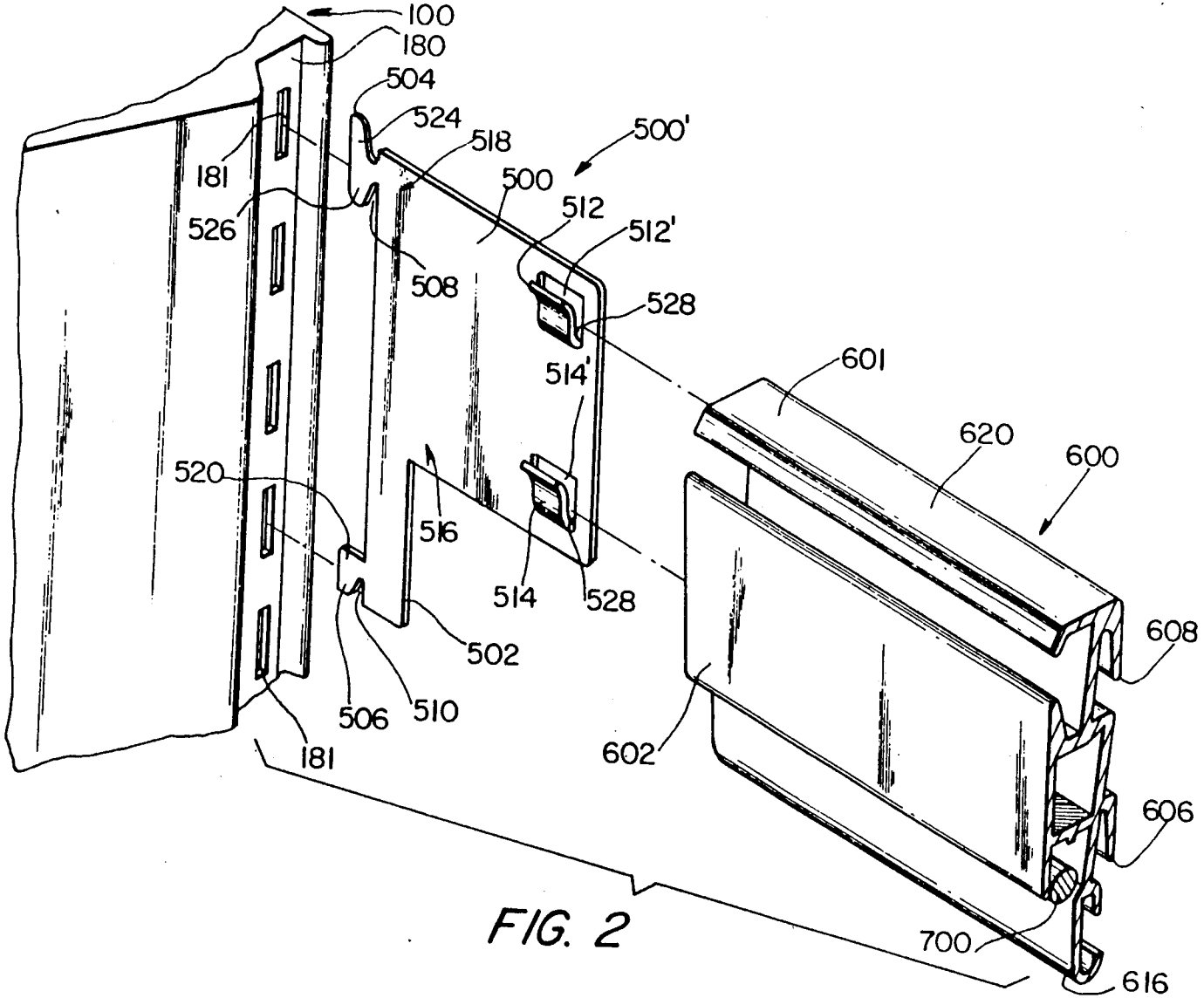
FIG. 2 is an exploded perspective view of one end of an accessory rail of the present invention, one embodiment of a mounting bracket of the present invention, and part of one of the structural stanchions of FIG. 1.

Referring now to FIGS. 1 and 2, an office furniture 10 system 5 is shown including a desk or work unit 7 and a pair of opposed, spaced-apart vertical structural stanchions 100. The present invention relates to apparatus for securement to and use in conjunction with stanchions and office furniture systems of the type disclosed in the co-pending United States patent application entitled "Furniture Stanchions With Unitary Power Routing System", filed on even date herewith and incorporated herein by reference.

The stanchions 100 each include a vertical, inward-facing bracket 180 such as a conventional shelf bracket to which plural accessories may be attached in cantilever fashion. The opposing inward-facing brackets may also be connected by a single device suspended between the two brackets. As shown in FIG. 1, such an accessory suspended between the two brackets may include an office accessory and document rail 600 according to the present invention. As shown in FIG. 1, a rail 600 includes a single, elongated piece of structurally strong material 601, preferably extruded aluminum, having two ends 600' and 600'' each secured to a mounting plate 500 which is interfitted with a stanchion bracket 180.

The mounting plate 500' of FIG. 2 serves as an adapter enabling the rail 600 according to the present invention to be used with many different modular office furniture systems. One embodiment of a mounting plate 500' usable with the rail 600 according to the present invention is shown in FIGS. 2 through 5, and includes a generally rectangular bracket body 500 having a downwardly extending, rectangular bracket arm 502 secured to one lower corner 516 of body 500. The bracket arm 502 is provided on one side with an inwardly-facing lower tooth 506, comprising an outwardly-extending lower tooth arm 520 secured at a right angle to bracket arm 502, and a generally triangular-shaped tooth point 522 secured to the bottom edge of arm 520. The tooth point 522 is tapered away from bracket arm 502 and thereby defines a lower grip notch 510 which is generally triangular, the triangle being oriented vertically opposite the triangular orientation of tooth point 522.

One upper corner 518 of bracket body 500 is further provided with an upper tooth 504. The tooth 504 comprises two oppositely-protruding tooth points 524 and 526 secured parallel to but pointing away from body 500. Tooth point 526 is generally configured as a downwardly-pointing triangular segment, and is spaced apart from body 500 to define an upper, upwardly-pointing triangular grip notch 508. Notches 508 and 510, and also teeth 504 and 506, are shaped to permit teeth 504 and 506 to be interfitted with the elongated, rectangular openings provided in a standard shelf bracket such as openings 181 of bracket 180. Thus, to secure bracket body 500, the teeth 504 and 506 are simultaneously pressed into a pair of axially aligned elongated openings 181 in the bracket 18 on stanchions 100. The bracket body 500 is then pulled down, forcing notches 508 and 510 against the upper edges of the elongated rectangular openings 181 provided in the bracket 180. This arrangement causes the bracket body 500 and the entire mounting plate 500' to be force-fit into the bracket 180, assuring a rigid, firm securement of the plate 500' to the bracket 180.

Figure 3:
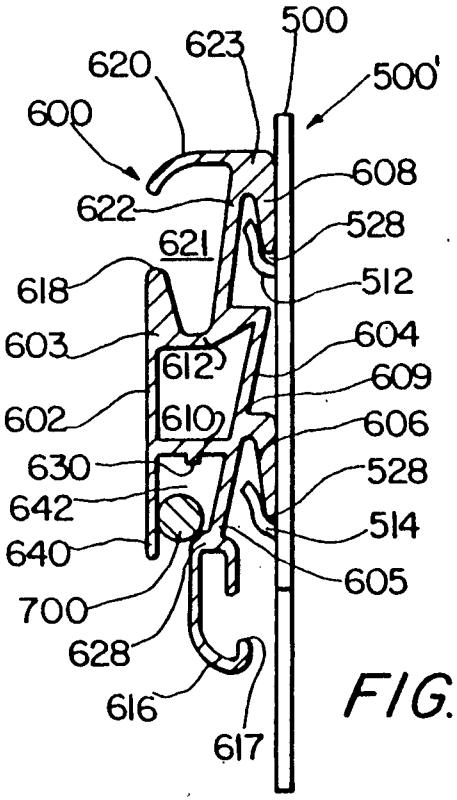
FIG. 3 is a section view taken along lines 3—3 of FIG. 2.

Bracket body 500 is further provided with an upper mounting tab 512 and a lower mounting tab 514 respectively located in the upper and lower inboard corners of bracket body 500. As shown in FIG. 3, the tabs 512 and 514 are punched or lanced outward from the same planer material which forms body 500, such that open windows 512' and 514', each resembling an inverted "U", surround tabs 512 and 514. The U-shaped windows 512' and 514' are created as a result of the punching or lancing process used in manufacturing. When tabs 512 and 514 are punched outwardly during the manufacturing process, they define an upwardly-facing, narrow grip channel 528 which separates each of the tabs 512 and 514 from the remainder of a plane defined by the front surface of body 500, as shown in FIG. 3. Channels 528 are disposed to enable a force-fit securement of the rear portion of a mounting rail according to the present invention. Thus, rear flanges 606 and 608 provided on the rail 600 according to the present invention, discussed more fully below, may be force-fit into channels 528 on each of tabs 512 and 514, enabling the rail 600 to forcibly fit into and be held by friction between tabs 512 and 514 and the body 500.

As shown in FIGS. 1, 2 and 3, the accessory mounting rail 600 of the present invention preferably comprises a single extruded aluminum rail 601 comprising integrally formed front plate 602 and rear plate 604. Plates 602 and 604 are joined at approximately their mid-point by interior web plate 610. The lower end 605 of plate 604 terminates in a rear-facing hook plate 616 having an elongated, upwardly protruding lip 617 on which plural accessories may be hung. Plate 604 is secured to web plate 610 at an obtuse angle, such that plate 604 is downwardly outwardly angled with respect to the vertical orientation of bracket body 500 shown in FIG. 3. This angled orientation of plate 604 permits lower end 605 to be separated from bracket body 500 by clearance space sufficient to clear hook 616.

Plates 602 and 604 are joined at their upper ends by an upper web strip 612. Secured to the approximate mid-point of strip 612 is a generally vertical, horizontally elongated upper arm 622. The upper end 623 of arm 622 terminates in an inwardly-facing curved top shield 620. In conjunction with the upwardly-protruding hanger 618, which hanger 618 is secured to the upper end 603 of front plate 602, shield 620 defines a generally "C"-shaped channel 621 which provides clearance and mounting space for demountable accessories 400, 460, and 470 of FIG. 1 such as the mini bulletin board 400 shown in FIG. 4. As FIG. 4 indicates in detail, the bulletin board 400 includes a rear surface 402 provided with a downwardly-facing hook 404. The hook 404 defines a grip channel 406 which cooperates with and snugly fits onto the protrusion 618 when the accessory is mounted on the rail 600. When bulletin board 400 is mounted in rail 600, the bulletin board assumes the position shown in FIG. 5.

Two downwardly-facing rail securement flanges 608 and 606 are secured, respectively, to the upper end 623 of plate 622 and to the mid-point 609 of rear plate 604. Flanges 608 and 606 are constructed having a thickness slightly greater than channel 528 which separates tabs 512 and 514 from bracket body 500. In operation, when rail 600 is to be mounted on bracket body 500, flange 608 is forced into space 528 behind tab 512, and flange 606 is simultaneously forced into the space 528 behind tab 514. The rail 600 thereafter assumes the mounted position shown in FIGS. 3, 4, and 5, with flanges 608 and 606 firmly seated between tabs 512 and 514 and bracket body 500.

A downward-facing channel 642, which in the cross-section of FIG. 3 generally resembles an inverted "U", is defined by the lower end 640 of plate 602, web plate 610, and the lower end 605 of plate 604. A steel rod segment 700 is movably mounted in channel 642, and is loosely retained in place by shoulder 628 provided adjacent lower end 605 of plate 604. Thus, rod segment 700 is free to move upward into channel 642, but ordinarily gravity forces rod 700 downward and against shoulder 628 and lower end 640 of plate 602.

Figure 5:
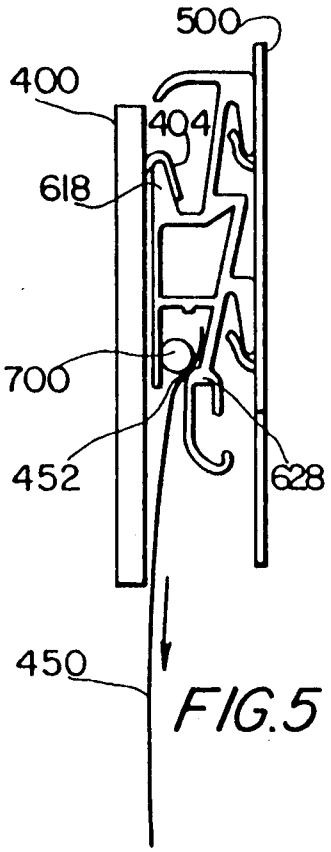
FIG. 5 is a schematic representation of a rail according to the present invention showing an accessory in mounted position on the rail and a sheet of material in retained position in the rail.
Figure 4:
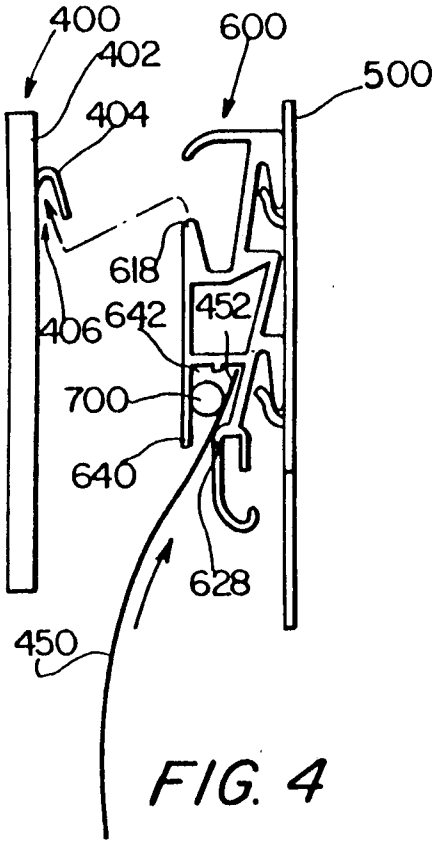
FIG. 4 is a schematic representation of a rail according to the present invention showing an office accessory about to be mounted on the rail and sheet material being inserted into the rail.

Rod 700 serves as a sheet retainer for flat, sheet material 450 such as note paper, card stock, or other flat sheet material common in the office environment. When an office worker desires to mount sheet material 450 in the rail 600 for display thereon, the sheet material 450 shown in FIG. 4 is pushed upward into channel 642, thereby displacing rod 700 and forcing rod 700 further upward into channel 642. As shown in FIG. 4, shoulder 628 acts as a guide for the sheet material, directing it upward into channel 642 and locating the sheet material between rod 700 and shoulder 628. As shown in FIG. 5, the position of shoulder 628 induces a slight curl 452 or role in the upper end 452 of sheet material 450 as the sheet 450 is inserted between rod 700 and shoulder 628. This curl 452 ensures that sufficient friction exists between the rod 700, material 450, and the shoulder 628 to retain the sheet material 450 in place.

When the sheet material 450 is then released, gravitational force pushes rod 700 down against shoulder 628, so that the material 450 and the rod 700 assume the position shown in FIG. 5. In this position, gravity presses rod 700 against sheet 450, retaining the sheet 540 in place against shoulder 628. In the position of FIG. 5, the sheet is retained in place and may be viewed or displayed a desired.

To remove sheet 450 from the position shown in FIG. 5, an office worker may pull downward on sheet 450. When sufficient downward pressure is exerted on sheet 450, the frictional force holding the sheet in place between rod 700 and shoulder 628 is overcome, forcing rod 700 to rotate about its longitudinal axis and allowing sheet 450 to be pulled from between rod 700 and shoulder 628.

In the preferred embodiment of the present invention, the rail 600 extends between and is supported by two brackets 500'mounted in two stanchions 100 as shown in FIG. 1. Stanchions 100 shown in FIG. 1 are typically separated by the width of a desk top 20, which may be several feet wide. Accordingly, a rail 600 of the present invention itself may have an overall length of several feet or more. Consequently, steel rods 700 of the present invention do not run the entire length of rail 600 but are preferably constructed in approximately one-foot lengths, to enable one or more pieces of sheet material 450 to be inserted into or removed from the rail 600 without displacing or disturbing other sheets secured in the rail 600 at other locations. Thus, if the rail 600 shown in FIG. 1 is five feet long, plural segments of steel rod 700 are employed, to enable a piece of sheet material placed at one end of the rail 600 to be withdrawn without disturbing or displacing sheets placed at the opposite end. This effect occurs because the separate segments of rod 700 may assume the positions shown in FIGS. 3, 4, and 5 independently, without affecting the position of the other segments of rod 700.

Many modifications and variations of the present invention are possible in light of the above teachings and specification. For example, the shape and configuration of bracket body 500 may be altered to enable the bracket 500 to cooperate with mounting brackets provided on modular office furniture of different design. Thus, the bracket 500 can serve as an adapter enabling a rail 600 to be mounted in different types and configurations of office furniture. Therefore, it should be understood that, within the scope of the appended claims, the invention may be practiced otherwise than as specifically described.

What is claimed is:

1. An office accessory mounting system for articles of office furniture, the office furniture including support means for securing accessories, the mounting system including:

(a) a rail mounting bracket comprising a rectangular, planar bracket body provided with plural planar outwardly protruding rail engagement tabs, said body further including plural linearly aligned outwardly extending bracket engagement means for securing said body on said support means; and (b) accessory mounting means for receiving, mounting and displaying plural office articles, said mounting means comprising an elongated rail formed of plural unitarily secured members including:

(i) front and rear spaced-apart, elongated frame plates and an elongated web plate, said front end rear frame plates each having top and bottom edges and each having interior surfaces joined inwardly of said top and bottom edges by said elongated web plate;

(ii) an elongated, rearwardly facing "C"-shaped hook plate extending from said bottom edge of said rear frame plate, said hook plate having an outwardly facing exterior surface including an elongated shoulder rib;

wherein said web plate and said front and rear frame plates extending downwardly of said web plate define an elongated, downwardly facing "U"-shaped channel, wherein said elongated rail further includes:

(i) an elongated rod movably mounted in said elongated channel; and (ii) top and bottom downward-facing elongated hanger means for mounting said rail on said planar outwardly protruding rail engagement tabs of said rail mounting bracket.

2. A mounting system for articles of furniture including elongate structural supports having a plurality of spaced-apart axially aligned openings therethrough, said system comprising:

(a) accessory mounting means for receiving, mounting and displaying plural office articles, said mounting means comprising an elongated rail having a front, a back, a top, and a bottom and including front hook means facing towards said front of said rail for removably mounting accessories on said front of said rail, back hook means facing towards said back of said rail for removably mounting accessories on said back of said rail, and sheet retaining means for removably retaining sheet-like materials; and (b) adaptor means for attaching said mounting means to the supports of the furniture, said adaptor means including a plurality of tabs for engaging the openings in the stanchions.

3. The mounting system of claim 2, wherein said front hook means is positioned at said top and said back hook means is positioned at said bottom.

4. The mounting system of claim 2, wherein said front and back hook means extend substantially the entire length of said rail.

5. The mounting system of claim 3, wherein said front and back hook means extend substantially the entire length of said rail.

6. The mounting system of claim 3, wherein said sheet retaining means including an elongated, downwardly facing "U"-shaped channel having a front wall and a back wall, and wherein said back hook means is attached to said back wall.

7. The mounting system of claim 6, wherein said sheet retaining means further includes an elongated rod movably mounted in said "U"-shaped channel.

8. The mounting system of claim 6, wherein said front and back hook means and said "U"-shaped channel are unitarily formed.

9. The mounting system of claim 3, wherein said back hook means includes a "C"-shaped channel.

* * * * *